US008872862B2

(12) United States Patent
Inoue

(10) Patent No.: US 8,872,862 B2
(45) Date of Patent: Oct. 28, 2014

(54) IMAGE DISPLAY DEVICE

(75) Inventor: Akihiko Inoue, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 692 days.

(21) Appl. No.: 13/138,196

(22) PCT Filed: Jan. 7, 2010

(86) PCT No.: PCT/JP2010/050079
§ 371 (c)(1),
(2), (4) Date: Jul. 19, 2011

(87) PCT Pub. No.: WO2010/134358
PCT Pub. Date: Nov. 25, 2010

(65) Prior Publication Data

US 2011/0273489 A1 Nov. 10, 2011

(30) Foreign Application Priority Data

May 22, 2009 (JP) ..... 2009-124752

(51) Int. Cl.
*G09G 3/36* (2006.01)

(52) U.S. Cl.
CPC ..... *G09G 3/3611* (2013.01); *G09G 2320/0285* (2013.01); *G09G 2310/066* (2013.01); *G09G 2320/103* (2013.01); *G09G 2360/18* (2013.01); *G09G 2340/16* (2013.01); *G09G 2320/0252* (2013.01); *G09G 2320/0233* (2013.01)
USPC ..... 345/690; 345/87

(58) Field of Classification Search
None
See application file for complete search history.

(56) References Cited

U.S. PATENT DOCUMENTS

| | | | | |
|---|---|---|---|---|
| 6,734,875 | B1 | 5/2004 | Tokimoto et al. | |
| 2004/0252895 | A1 | 12/2004 | Hur et al. | |
| 2005/0001802 | A1 | 1/2005 | Lee | |
| 2005/0024353 | A1 | 2/2005 | Amundson et al. | |
| 2005/0200619 | A1 | 9/2005 | Adachi et al. | |
| 2006/0152463 | A1 | 7/2006 | Furihata et al. | |
| 2006/0262059 | A1 | 11/2006 | Hashimoto et al. | |
| 2007/0247413 | A1* | 10/2007 | Maruyama et al. | 345/101 |
| 2007/0285371 | A1 | 12/2007 | Nam et al. | |
| 2008/0074367 | A1 | 3/2008 | Kimura | |
| 2008/0174534 | A1* | 7/2008 | Park | 345/87 |
| 2009/0109247 | A1 | 4/2009 | Kimura | |

FOREIGN PATENT DOCUMENTS

| | | |
|---|---|---|
| CN | 1828698 | 9/2006 |
| EP | 1735771 | 12/2006 |
| EP | 2 065 879 | 6/2009 |
| JP | 2000231091 A | 8/2000 |
| JP | 2004287139 A | 10/2004 |
| JP | 200549840 A | 2/2005 |

(Continued)

*Primary Examiner* — Joseph Haley
(74) *Attorney, Agent, or Firm* — Harness, Dickey & Pierce, P.L.C.

(57) ABSTRACT

A gradation change detection circuit determines whether a gradation value has been changed from a previous frame. In at least one example embodiment, a first frame memory stores, when the gradation value is changed, a gradation value before change. A hold count calculation circuit determines a hold count indicating the number of frames inputted after the change of the gradation value. A second frame memory stores the determined hold counts. An emphasis conversion circuit performs a process of emphasizing a change in gradation value on a video signal, and makes a degree of emphasis smaller with a larger hold count. A liquid crystal panel is driven based on a video signal obtained by an overdrive circuit. By this, double optical responsivity occurring due to overdrive drive is prevented.

11 Claims, 10 Drawing Sheets

(56) References Cited

FOREIGN PATENT DOCUMENTS

| | | | |
|---|---|---|---|
| JP | 200591454 | A | 4/2005 |
| JP | 2005301220 | A | 10/2005 |
| JP | 2006195170 | A | 7/2006 |
| JP | 2006-330101 | | 12/2006 |
| JP | 2007-104377 | | 4/2007 |
| JP | 2007-334321 | | 12/2007 |
| JP | 2008-292774 | | 12/2008 |
| JP | 2009-053706 | | 3/2009 |
| JP | 2009-058684 | | 3/2009 |
| JP | 2009103957 | A | 5/2009 |
| RU | 2113066 | | 6/1988 |
| RU | 2249858 | | 3/2000 |
| WO | WO 89/06417 | | 7/1989 |
| WO | WO 2005/096263 | | 10/2005 |

* cited by examiner

*Fig. 3*

| HOLD COUNT Cnt** | GRADATION VALUE BEFORE CHANGE Din(hold)** | CURRENT FRAME GRADATION VALUE Din(n)** | | | | | | | | |
|---|---|---|---|---|---|---|---|---|---|---|
| | | 0 | 32 | 64 | 96 | 128 | 160 | 192 | 224 | 255 |
| 1 | 0 | 0 | 90 | ***160*** | 192 | 210 | 225 | 238 | 248 | 255 |
| | 32 | 0 | 32 | 90 | 154 | 192 | 215 | 233 | 246 | 255 |
| | 64 | 0 | 25 | 64 | 120 | ***166*** | 200 | 227 | 243 | 255 |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| 2 | 0 | | | ***76*** | | | | | | |
| | ⋮ | | | | | | | | | |
| | 255 | | | | | | | | | |
| 3 | 0 | | | ***68*** | | | | | | |
| | ⋮ | | | | | | | | | |
| | 255 | | | | | | | | | |
| 4 | 0 | | | ***66*** | | | | | | |
| | ⋮ | | | | | | | | | |
| | 255 | | | | | | | | | |
| 5 | 0 | | | ***65*** | | | | | | |
| | ⋮ | | | | | | | | | |
| | 255 | | | | | | | | | |
| 6 | 0 | | | ***65*** | | | | | | |
| | ⋮ | | | | | | | | | |
| | 255 | | | | | | | | | |
| 7 | 0 | | | ***65*** | | | | | | |
| | ⋮ | | | | | | | | | |
| | 255 | | | | | | | | | |

*Fig. 4A*
| TIME (FRAME) | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Din(n) | 0 | 0 | 0 | 64 | 64 | 64 | 64 | 64 | 64 | 64 | 64 | 64 | 64 | 64 | 64 | 64 | 64 | 64 |
| Din(n-1) | 0 | 0 | 0 | 0 | 64 | 64 | 64 | 64 | 64 | 64 | 64 | 64 | 64 | 64 | 64 | 64 | 64 | 64 |
| Cmp* | 0 | 0 | 0 | 1 | 0 | 0 | 0 | 0 | 0 | 0 | 0 | 0 | 0 | 0 | 0 | 0 | 0 | 0 |
| Din(n-1)* | 0 | 0 | 0 | 0 | 64 | 64 | 64 | 64 | 64 | 64 | 64 | 64 | 64 | 64 | 64 | 64 | 64 | 64 |
| Din(n)** | 0 | 0 | 0 | 64 | 64 | 64 | 64 | 64 | 64 | 64 | 64 | 64 | 64 | 64 | 64 | 64 | 64 | 64 |
| Cnt** | 0 | 0 | 0 | 1 | 2 | 3 | 4 | 5 | 6 | 7 | 0 | 0 | 0 | 0 | 0 | 0 | 0 | 0 |
| Din(hold)** | 32 | 32 | 32 | 0 | 0 | 0 | 0 | 0 | 0 | 0 | 0 | 0 | 0 | 0 | 0 | 0 | 0 | 0 |
| Dout(n) | 0 | 0 | 0 | 160 | 76 | 68 | 66 | 65 | 65 | 65 | 64 | 64 | 64 | 64 | 64 | 64 | 64 | 64 |
*Fig. 4B*
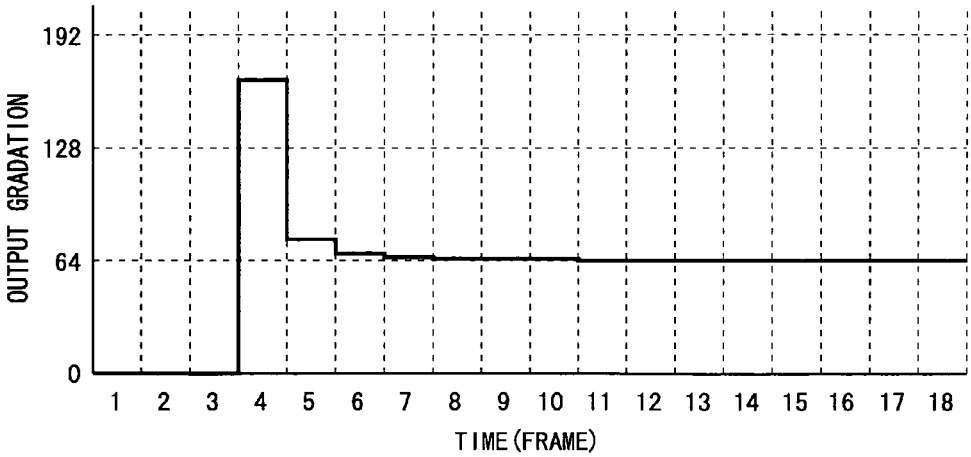
*Fig. 4C*
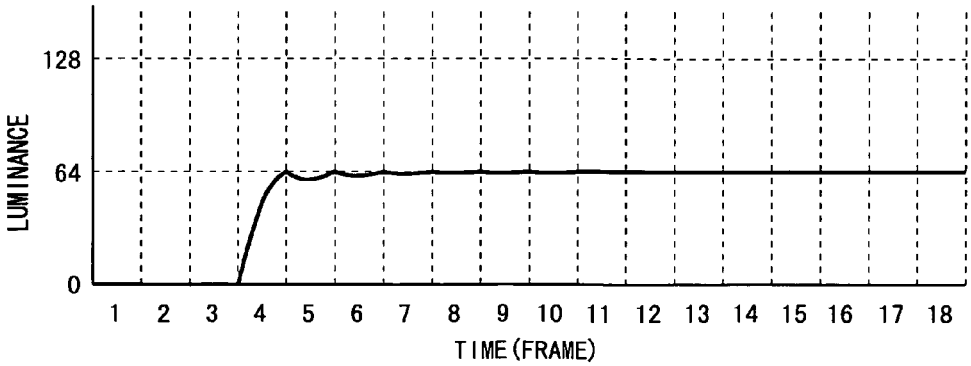

*Fig. 5A*
| TIME(FRAME) | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Din(n) | 0 | 0 | 0 | 64 | 64 | 64 | 64 | 128 | 128 | 128 | 128 | 128 | 128 | 128 | 128 | 128 | 128 | 128 |
| Din(n-1) | 0 | 0 | 0 | 0 | 64 | 64 | 64 | 64 | 128 | 128 | 128 | 128 | 128 | 128 | 128 | 128 | 128 | 128 |
| Cmp* | 0 | 0 | 0 | 1 | 0 | 0 | 0 | 1 | 0 | 0 | 0 | 0 | 0 | 0 | 0 | 0 | 0 | 0 |
| Din(n-1)* | 0 | 0 | 0 | 0 | 64 | 64 | 64 | 64 | 128 | 128 | 128 | 128 | 128 | 128 | 128 | 128 | 128 | 128 |
| Din(n)** | 0 | 0 | 0 | 64 | 64 | 64 | 64 | 128 | 128 | 128 | 128 | 128 | 128 | 128 | 128 | 128 | 128 | 128 |
| Cnt** | 0 | 0 | 0 | 1 | 2 | 3 | 4 | 1 | 2 | 3 | 4 | 5 | 6 | 7 | 0 | 0 | 0 | 0 |
| Din(hold)** | 32 | 32 | 32 | 0 | 0 | 0 | 0 | 64 | 64 | 64 | 64 | 64 | 64 | 64 | 64 | 64 | 64 | 64 |
| Dout(n) | 0 | 0 | 0 | 160 | 76 | 68 | 66 | 166 | 137 | 133 | 131 | 129 | 129 | 128 | 128 | 128 | 128 | 128 |
*Fig. 5B*
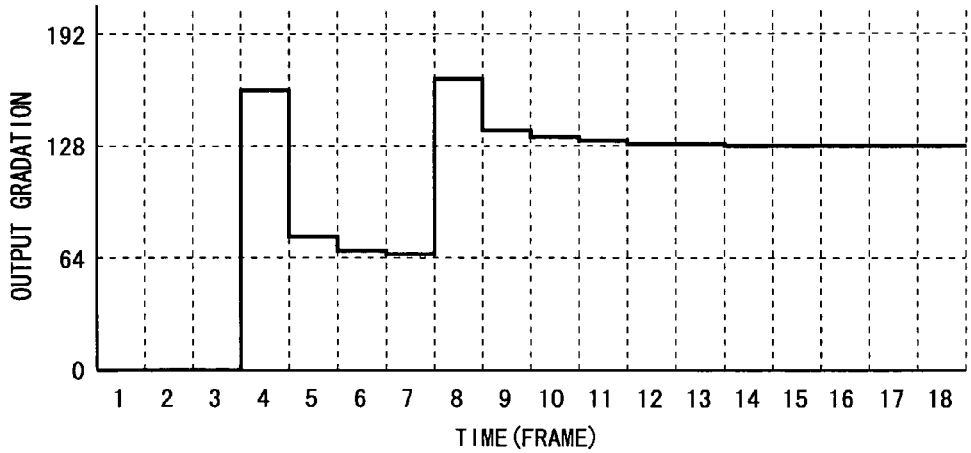
*Fig. 5C*
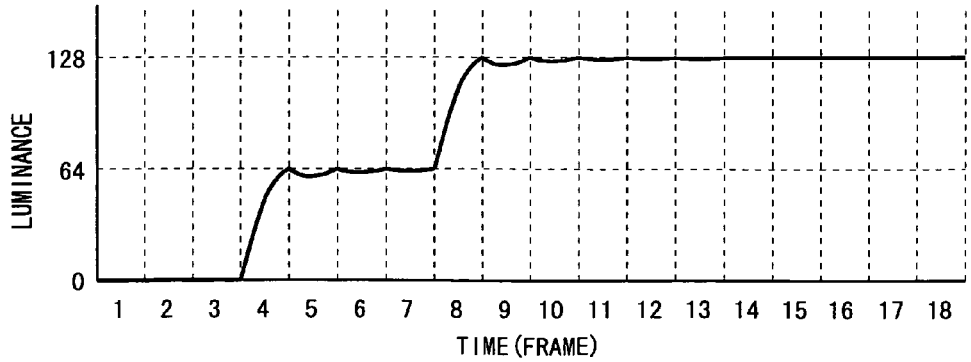

*Fig. 6A*
| TIME (FRAME) | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Din(n) | 128 | 128 | 128 | 64 | 64 | 64 | 64 | 128 | 128 | 128 | 128 | 128 | 128 | 128 | 128 | 128 | 128 | 128 |
| Din(n−1) | 0 | 0 | 0 | 0 | 64 | 64 | 64 | 64 | 128 | 128 | 128 | 128 | 128 | 128 | 128 | 128 | 128 | 128 |
| Cmp* | 0 | 0 | 0 | 1 | 0 | 0 | 0 | 1 | 0 | 0 | 0 | 0 | 0 | 0 | 0 | 0 | 0 | 0 |
| Din(n−1)* | 0 | 0 | 0 | 0 | 64 | 64 | 64 | 64 | 128 | 128 | 128 | 128 | 128 | 128 | 128 | 128 | 128 | 128 |
| Din(n)** | 128 | 128 | 128 | 64 | 64 | 64 | 64 | 128 | 128 | 128 | 128 | 128 | 128 | 128 | 128 | 128 | 128 | 128 |
| Cnt** | 0 | 0 | 0 | 1 | 2 | 3 | 4 | 1 | 2 | 3 | 4 | 5 | 6 | 7 | 0 | 0 | 0 | 0 |
| Din(hold)** | 0 | 0 | 0 | 128 | 128 | 128 | 128 | 64 | 64 | 64 | 64 | 64 | 64 | 64 | 64 | 64 | 64 | 64 |
| Dout(n) | 0 | 0 | 0 | 32 | 62 | 64 | 64 | 166 | 137 | 133 | 131 | 129 | 129 | 128 | 128 | 128 | 128 | 128 |
*Fig. 6B*
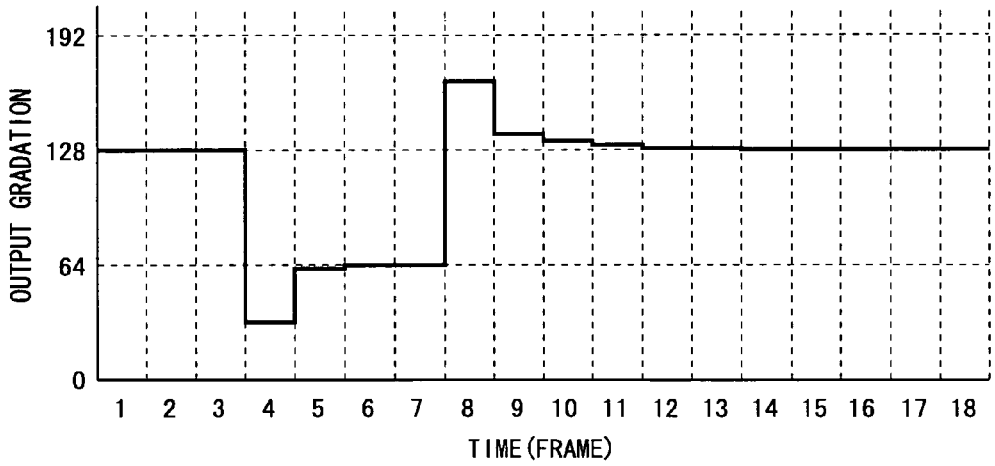
*Fig. 6C*
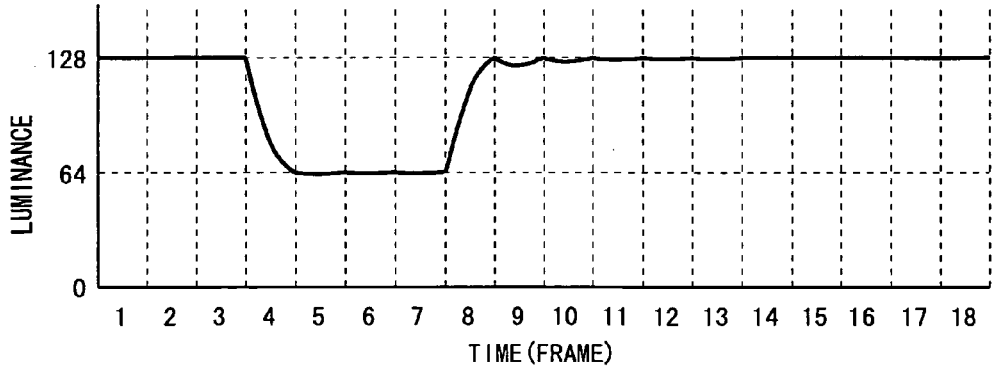

*Fig. 7A*
| TIME (FRAME) | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Din(n) | 0 | 0 | 0 | 64 | 64 | 64 | 67 | 64 | 64 | 64 | 64 | 64 | 64 | 64 | 64 | 64 | 64 | 64 |
| Din(n-1) | 0 | 0 | 0 | 0 | 64 | 64 | 64 | 67 | 64 | 64 | 64 | 64 | 64 | 64 | 64 | 64 | 64 | 64 |
| Cmp* | 0 | 0 | 0 | 1 | 0 | 0 | 0 | 0 | 0 | 0 | 0 | 0 | 0 | 0 | 0 | 0 | 0 | 0 |
| Din(n-1)* | 0 | 0 | 0 | 0 | 64 | 64 | 64 | 67 | 64 | 64 | 64 | 64 | 64 | 64 | 64 | 64 | 64 | 64 |
| Din(n)** | 0 | 0 | 0 | 64 | 64 | 64 | 67 | 64 | 64 | 64 | 64 | 64 | 64 | 64 | 64 | 64 | 64 | 64 |
| Cnt** | 0 | 0 | 0 | 1 | 2 | 3 | 4 | 5 | 6 | 7 | 0 | 0 | 0 | 0 | 0 | 0 | 0 | 0 |
| Din(hold)** | 32 | 32 | 32 | 0 | 0 | 0 | 0 | 0 | 0 | 0 | 0 | 0 | 0 | 0 | 0 | 0 | 0 | 0 |
| Dout(n) | 0 | 0 | 0 | 160 | 76 | 68 | 69 | 65 | 65 | 65 | 64 | 64 | 64 | 64 | 64 | 64 | 64 | 64 |
*Fig. 7B*
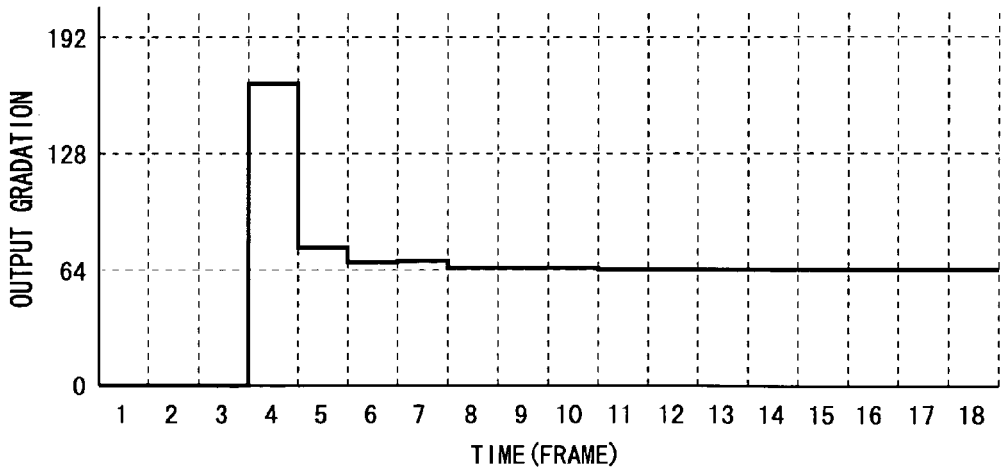
*Fig. 7C*
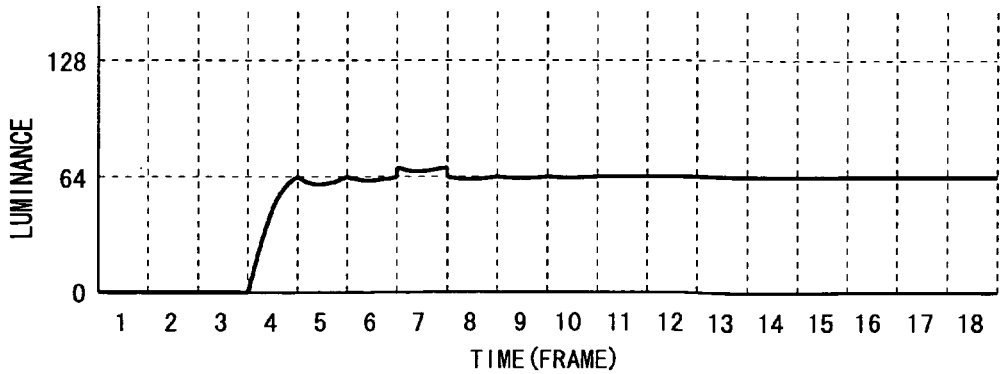

IMAGE DISPLAY DEVICE

TECHNICAL FIELD

The present invention relates to an image display device such as a liquid crystal display device.

BACKGROUND ART

As a technique to improve the response speed of a display panel included in an image display device, overdrive drive (also called overshoot drive) is conventionally known. In conventional typical overdrive drive, when the gradation value of a pixel included in a video signal is changed to a high (low) value, a voltage higher (lower) than a voltage required to obtain a desired luminance (a luminance corresponding to the gradation value after change) is applied to a pixel circuit in a display panel in the first frame period occurring after the change of the gradation value. The following discusses a liquid crystal display device as an example of an image display device.

In a liquid crystal display device that does not perform overdrive drive, when the drive voltage of a pixel is changed as shown in FIG. 9A, the luminance of the pixel changes as shown in FIG. 9B. As shown in FIGS. 9A and 9B, when the drive voltage is changed with the change of a gradation value (not shown), the luminance changes slowly and thus it may take several frame periods for the luminance to reach a desired level.

On the other hand, in a liquid crystal display device that performs overdrive drive, the drive voltage of a pixel changes as shown in FIG. 10A, and the luminance of the pixel changes as shown in FIG. 10B. As shown in FIGS. 10A and 10B, in one frame period starting from time 0, the drive voltage gets higher than a level required to obtain a desired luminance and the luminance changes sharply and reaches a desired level in a short time. As such, by performing overdrive drive, the response speed of a liquid crystal panel can be improved.

Liquid crystal display devices performing overdrive drive are described in, for example, Patent Documents 1 to 3. Of them, Patent Document 2 describes a liquid crystal display device shown in FIG. 11. In FIG. 11, an emphasis conversion unit 93 obtains an emphasis conversion signal that compensates for the optical response characteristics of a liquid crystal display panel 94, based on an input image signal (a current frame image signal), an image signal of a previous frame period which is stored in a frame memory 91, and an image signal of a second previous frame period which is stored in a frame memory 92. The drive voltage of a pixel gets higher than a level required to obtain a desired luminance, over two frame periods occurring after the change of a gradation value (see FIG. 12A), and the luminance of the pixel changes as shown in FIG. 12B. By this, the occurrence of an after-image when performing moving image display is suppressed and a halftone can be displayed properly.

PRIOR ART DOCUMENTS

Patent Documents

[Patent Document 1] Japanese Laid-Open Patent Publication No. 2000-231091

[Patent Document 2] Japanese Laid-Open Patent Publication No. 2004-287139

[Patent Document 3] Japanese Laid-Open Patent Publication No. 2005-49840

SUMMARY OF THE INVENTION

Problems to be Solved by the Invention

However, in a conventional liquid crystal display device performing overdrive drive, a phenomenon may occur where the luminance of a pixel increases once immediately after the application of a drive voltage and decreases thereafter and increases again (or the luminance of a pixel decreases once immediately after the application of a drive voltage and increases thereafter and decreases again). This phenomenon is hereinafter referred to as double optical responsivity. If double optical responsivity occurs, when a user visually watches a screen displaying a moving image (e.g., a scroll screen), he/she recognizes the luminance of an edge portion as abnormally high (this phenomenon is hereinafter referred to as angular response). If the drive voltage is lowered to prevent angular response, then the effect of an improvement in response speed brought about by overdrive drive is impaired.

Double optical responsivity is likely to occur in, for example, an MVA (Multi-domain Vertical Alignment)-type liquid crystal panel. In the MVA-type liquid crystal panel, an alignment film surface is not subjected to a rubbing process as a domain control means and liquid crystal molecules are pretilted at a small angle by protrusions, etc., provided on a part of an electrode. Hence, at the moment of application of a drive voltage to a pixel, first, liquid crystal molecules close to a protruding portion rapidly respond, and thereafter, liquid crystal molecules in a domain are sequentially aligned like a domino toppling. Accordingly, when overdrive drive is performed, although the luminance of an area around a protruding portion in a domain changes rapidly, the luminance of an area other than the area around the protruding portion changes with a lag (see FIG. 13). As such, because overdrive drive is performed on an MVA-type liquid crystal panel does not mean the luminance rapidly changes in all areas in a domain.

When the user visually watches a liquid crystal panel, he/she recognizes the average luminance in a domain as luminance. FIG. 13 is a diagram showing a detail of the changes in luminance shown in FIG. 10B. As shown in FIG. 13, in the first frame period occurring after the change of a gradation value, both the luminance of an area around a protruding portion and the luminance of an area other than the area around the protruding portion increase and thus the average luminance increases. In the next frame period, since the luminance of the area around the protruding portion decreases at a higher speed than a speed at which the luminance of the area other than the area around the protruding portion increases, the average luminance decreases. In subsequent frame periods, the luminance of the area around the protruding portion becomes substantially constant and the luminance of the area other than the area around the protruding portion increases, and thus, the average luminance increases. As a result, double optical responsivity where the luminance of a pixel increases once and decreases thereafter and increases again occurs.

Even in the liquid crystal display device shown in FIG. 11, when the response speed of the liquid crystal display panel 94 is slow, the luminance of a pixel changes as shown in FIG. 12B. As such, even the liquid crystal display device shown in FIG. 11 cannot completely prevent double optical responsivity.

An object of the present invention is therefore to provide an image display device capable of preventing double optical responsivity occurring due to overdrive drive.

Means for Solving the Problems

According to a first aspect of the present invention, there is provided an image display device that performs signal processing on a video signal and thereby displays an image, the image display device including: a display panel; a first storage unit that stores, when a gradation value of a pixel included in an input video signal has been changed from a previous frame, a gradation value before change, for each pixel; a hold count calculation unit that determines, for each pixel, a hold count indicating a number of frames inputted after a change of a gradation value; a second storage unit that stores the hold counts determined by the hold count calculation unit; an emphasis conversion unit that obtains an emphasis video signal based on the input video signal, the gradation values before change which are stored in the first storage unit, and the hold counts determined by the hold count calculation unit, the emphasis video signal compensating for optical response characteristics of the display panel; and a drive unit that drives the display panel based on the emphasis video signal.

According to a second aspect of the present invention, in the first aspect of the present invention, the image display device further includes: a third storage unit that stores one frame of the input video signal and outputs a video signal of the previous frame; and a gradation change detection unit that compares the input video signal with the video signal of the previous frame outputted from the third storage unit to determine, for each pixel, whether a gradation value has been changed from the previous frame.

According to a third aspect of the present invention, in the second aspect of the present invention, when a gradation value of a pixel is changed by a value greater than or equal to a predetermined value between the input video signal and the video signal of the previous frame outputted from the third storage unit, the gradation change detection unit determines that the gradation value has been changed from the previous frame.

According to a fourth aspect of the present invention, in the first aspect of the present invention, a maximum value of the hold counts determined by the hold count calculation unit is 3 or more.

According to a fifth aspect of the present invention, in the first aspect of the present invention, the emphasis conversion unit obtains an emphasis video signal where the changes in gradation values are emphasized more than those in the input video signal, and makes a degree of emphasis smaller with larger hold counts determined by the hold count calculation unit.

According to a sixth aspect of the present invention, in the fifth aspect of the present invention, the emphasis conversion unit includes a look up table and obtains the emphasis video signal using the look up table.

According to a seventh aspect of the present invention, in the fifth aspect of the present invention, the emphasis conversion unit includes an arithmetic circuit and obtains the emphasis video signal using the arithmetic circuit.

According to an eighth aspect of the present invention, in the fifth aspect of the present invention, the emphasis conversion unit includes a look up table and an arithmetic circuit and obtains the emphasis video signal using the look up table and the arithmetic circuit.

According to a ninth aspect of the present invention, in the first aspect of the present invention, the display panel has a response speed slower than two frame periods.

According to a tenth aspect of the present invention, in the ninth aspect of the present invention, the display panel is an MVA-type liquid crystal panel.

According to an eleventh aspect of the present invention, there is provided an image display method for performing signal processing on a video signal and thereby displaying an image on a display panel, the method including the steps of: storing, when a gradation value of a pixel included in an input video signal has been changed from a previous frame, a gradation value before change, for each pixel; determining, for each pixel, a hold count indicating a number of frames inputted after a change of a gradation value; storing the determined hold counts; obtaining an emphasis video signal based on the input video signal, the stored gradation values before change, and the determined hold counts, the emphasis video signal compensating for optical response characteristics of the display panel; and driving the display panel based on the emphasis video signal.

Effects of the Invention

According to the first or eleventh aspect of the present invention, an emphasis video signal that compensates for the optical response characteristics of a display panel is obtained based on an input video signal, gradation values before change, and the hold counts, and the display panel is driven based on the emphasis video signal. As such, by obtaining an emphasis video signal according to the elapsed time after the change of gradation value by referring to the hold counts, the optical response characteristics of the display panel are favorably compensated for, enabling to prevent double optical responsivity occurring due to overdrive drive.

According to the second aspect of the present invention, a determination as to whether a gradation value has been changed from the previous frame can be easily made using a third storage unit and a gradation change detection unit.

According to the third aspect of the present invention, when a gradation value is changed by a certain degree or more, it is determined that the gradation value has been changed from the previous frame. This can prevent a situation where, when a gradation value slightly fluctuates due to the influence of noise, display is performed with the noise being emphasized by overdrive drive.

According to the fourth aspect of the present invention, by referring to the hold counts whose maximum value is 3 or more, elapsed time after the change of gradation value is measured for at least three frame periods, and an emphasis video signal according to the elapsed time is obtained. By this, the optical response characteristics of the display panel are favorably compensated for, enabling to prevent double optical responsivity occurring due to overdrive drive.

According to the fifth aspect of the present invention, when an emphasis video signal is obtained by performing a process of emphasizing changes in gradation values on an input video signal, the degree of emphasis is made smaller with longer elapsed time after the change of gradation value by referring to the hold counts. By this, an emphasis video signal capable of favorably compensating for the optical response characteristics of the display panel can be obtained. By driving the display panel based on the emphasis video signal, double optical responsivity occurring due to overdrive drive can be prevented.

According to the sixth aspect of the present invention, by referring to a look up table, an emphasis video signal can be obtained accurately and easily.

According to the seventh aspect of the present invention, by obtaining an emphasis video signal using an arithmetic circuit, the amount of circuitry for the look up table can be reduced.

According to the eighth aspect of the present invention, by providing a look up table and an arithmetic circuit, the amount of circuitry can be reduced over the case of providing only the look up table, and an emphasis video signal can be obtained accurately and easily over the case of providing only the arithmetic circuit.

According to the ninth aspect of the present invention, in an image display device including a display panel with a response speed slower than two frame periods, double optical responsivity that occurs over two frame periods or more due to overdrive drive can be prevented.

According to the tenth aspect of the present invention, in a liquid crystal display device including an MVA-type liquid crystal panel which is likely to cause double optical responsivity due to overdrive drive, double optical responsivity can be prevented.

BRIEF DESCRIPTION OF THE DRAWINGS

FIG. 3 is a diagram showing an exemplary configuration of a look up table included in the overdrive circuit shown in FIG. 2.

FIG. 4A is a diagram showing an example (first example) of changes in signal values in the overdrive circuit shown in FIG. 2.

FIG. 4B is a diagram showing an example (first example) of changes in output gradation value determined by the overdrive circuit shown in FIG. 2.

FIG. 4C is a diagram showing an example (first example) of changes in luminance in the liquid crystal display device shown in FIG. 1.

FIG. 5A is a diagram showing an example (second example) of changes in signal values, as in FIG. 4A.

FIG. 5B is a diagram showing an example (second example) of changes in output gradation value, as in FIG. 4B.

FIG. 5C is a diagram showing an example (second example) of changes in luminance, as in FIG. 4C.

FIG. 6A is a diagram showing an example (third example) of changes in signal values, as in FIG. 4A.

FIG. 6B is a diagram showing an example (third example) of changes in output gradation value, as in FIG. 4B.

FIG. 6C is a diagram showing an example (third example) of changes in luminance, as in FIG. 4C.

FIG. 7A is a diagram showing an example (fourth example) of changes in signal values, as in FIG. 4A.

FIG. 7B is a diagram showing an example (fourth example) of changes in output gradation value, as in FIG. 4B.

FIG. 7C is a diagram showing an example (fourth example) of changes in luminance, as in FIG. 4C.

MODE FOR CARRYING OUT THE INVENTION

Figure 1:
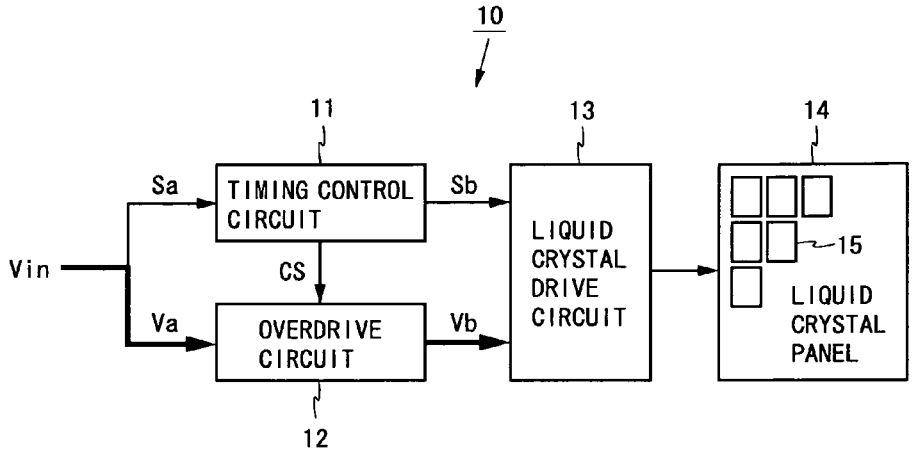
FIG. 1 is a block diagram showing a configuration of a liquid crystal display device according to an embodiment of the present invention.

FIG. 1 is a block diagram showing a configuration of a liquid crystal display device according to an embodiment of the present invention. A liquid crystal display device 10 shown in FIG. 1 includes a timing control circuit 11, an overdrive circuit 12, a liquid crystal drive circuit 13, and a liquid crystal panel 14. The liquid crystal panel 14 includes a plurality of pixel circuits 15 arranged two-dimensionally. The liquid crystal display device 10 performs signal processing on an input video signal Vin supplied from an external source, and thereby displays an image on the liquid crystal panel 14.

The input video signal Vin includes a video signal Va which is image data and a synchronizing signal Sa indicating display timing. The video signal Va is inputted to the overdrive circuit 12 and the synchronizing signal Sa is inputted to the timing control circuit 11. The timing control circuit 11 outputs, based on the synchronizing signal Sa, a control signal CS for the overdrive circuit 12 and a synchronizing signal Sb for the liquid crystal drive circuit 13. The overdrive circuit 12 performs signal processing for compensating for the optical response characteristics of the liquid crystal panel 14, on the video signal Va according to the control signal CS, and outputs an obtained video signal Vb to the liquid crystal drive circuit 13. The liquid crystal drive circuit 13 drives the liquid crystal panel 14 based on the synchronizing signal Sb and the video signal Vb. Voltages according to the video signal Vb obtained by the overdrive circuit 12 are applied to the pixel circuits 15 included in the liquid crystal panel 14. In this manner, an image based on the input video signal Vin is continuously displayed on the liquid crystal panel 14.

Figure 2:
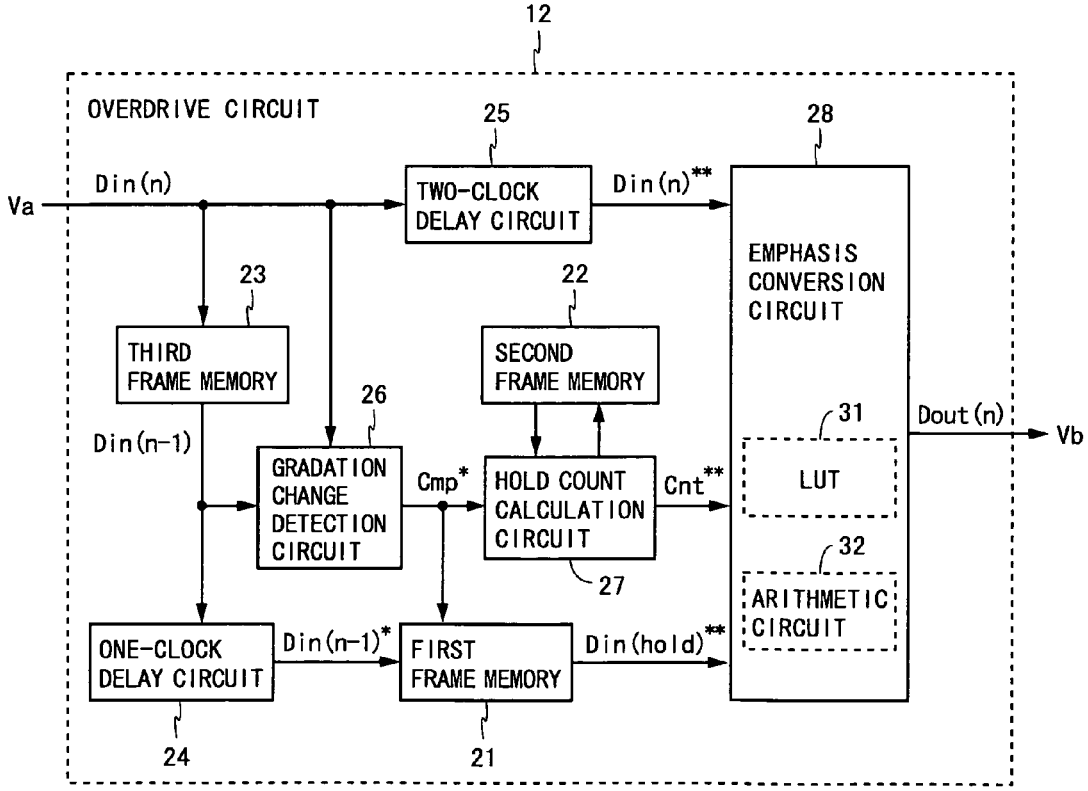
FIG. 2 is a block diagram showing a detail of an overdrive circuit in the liquid crystal display device shown in FIG. 1.

FIG. 2 is a block diagram showing a detail of the overdrive circuit 12. As shown in FIG. 2, the overdrive circuit 12 includes first to third frame memories 21 to 23, a one-clock delay circuit 24, a two-clock delay circuit 25, a gradation change detection circuit 26, a hold count calculation circuit 27, and an emphasis conversion circuit 28. The emphasis conversion circuit 28 includes a look up table (hereinafter, referred to as LUT) 31 and an arithmetic circuit 32.

In the following, it is assumed that the video signal Va inputted to the overdrive circuit 12 has a resolution of 1920×1080 pixels and includes an 8-bit gradation value for each of RGB of each pixel. A gradation value included in the video signal Va is referred to as a current frame gradation value Din(n) and a gradation value included in the video signal Vb is referred to as an output gradation value Dout(n). Note that the resolution and number of gradation levels of the video signal Va may be arbitrarily determined according to the specifications of the liquid crystal display device 10.

The third frame memory 23 has a capacity capable of storing at least one frame of the video signal Va. The third frame memory 23 stores one frame of the video signal Va and outputs the stored video signal after one frame period, as a previous frame video signal. When the video signal Va has the above-described format (1920×1080 pixels and 8 bits for each of RGB), as the third frame memory 23, a memory having a capacity of 49,766,400 bits (=1920×1080×3×8) or more is used. A gradation value included in the video signal outputted from the third frame memory 23 is referred to as an immediately previous frame gradation value Din(n−1). Note that the superscript symbol * indicates that data is delayed by one clock.

The gradation change detection circuit 26 compares the video signal Va with the video signal outputted from the third frame memory 23 and outputs a gradation comparison result Cmp* indicating for each pixel whether the gradation value has been changed from the previous frame. More specifically, the gradation change detection circuit 26 calculates a difference between the current frame gradation value Din(n) and the immediately previous frame gradation value Din(n−1) (hereinafter, referred to as the amount of gradation change). If the amount of gradation change is greater than or equal to a predetermined threshold value, then the gradation change detection circuit 26 determines that there is a change in gradation and thus outputs Cmp*=1. If the amount of gradation change is less than the threshold value, then the gradation change detection circuit 26 determines that there is no change in gradation and thus outputs Cmp*=0. For example, when the threshold value is 5, the gradation change detection circuit 26 outputs Cmp*=1 when the amount of gradation change is ±5 or more, and outputs Cmp*=0 when the amount of gradation change is within ±4 gradation levels. The threshold value of the amount of gradation change is determined according to the characteristics of the video signal Va, etc. As such, when the gradation value of a pixel is changed by a value greater than or equal to the predetermined value between the video signal Va and the video signal outputted from the third frame memory 23, the gradation change detection circuit 26 determines that the gradation value has been changed from the previous frame.

The one-clock delay circuit 24 and the two-clock delay circuit 25 are provided to adjust the timing of signal processing in the overdrive circuit 12. The one-clock delay circuit 24 delays the video signal outputted from the third frame memory 23 by one clock and outputs the delayed video signal. The two-clock delay circuit 25 delays the video signal Va by two clocks and outputs the delayed video signal Va. A gradation value included in the video signal outputted from the one-clock delay circuit 24 is referred to as Din(n−1)*, and a gradation value included in the video signal outputted from the two-clock delay circuit 25 is referred to as Din(n)**.

The first frame memory 21 has a capacity capable of storing at least one frame of the video signal Va, as with the third frame memory 23. When the gradation values of pixels included in the video signal Va are changed, the first frame memory 21 stores, for each pixel, a gradation value before change. More specifically, a gradation value stored in the first frame memory 21 is updated to a gradation value Din(n−1)* outputted from the one-clock delay circuit 24, when the gradation change detection circuit 26 determines that there is a change in gradation (when Cmp*=1), and is held without being updated when the gradation change detection circuit 26 determines that there is no change in gradation (when Cmp*=0). A gradation value before change which is stored in the first frame memory 21 is referred to as Din(hold). Note that the superscript symbol  indicates that data is delayed by two clocks.

The second frame memory 22 and the hold count calculation circuit 27 are provided to determine, for each pixel, the number of frames inputted after the change of a gradation value (hereinafter, referred to as the hold count). The second frame memory 22 stores, for each pixel, the hold count which is determined for the immediately previous frame. The hold count calculation circuit 27 determines, for each pixel, the hold count for the current frame based on the gradation comparison result obtained by the gradation change detection circuit 26 and the hold count for the immediately previous frame which is outputted from the second frame memory 22.

More specifically, when the gradation change detection circuit 26 determines that there is a change in gradation (Cmp*=1), the hold count calculation circuit 27 sets the hold count for the current frame to 1, regardless of the hold count for the immediately previous frame. On the other hand, when the gradation change detection circuit 26 determines that there is no change in gradation (Cmp*=0), the hold count calculation circuit 27 sets a value obtained by adding 1 to the hold count for the immediately previous frame, as the hold count for the current frame. Note, however, that a maximum value is set for the hold count, and when a result where 1 is added exceeds the maximum value, the hold count calculation circuit 27 resets the hold count for the current frame to 0. The hold count Cnt determined by the hold count calculation circuit 27 is outputted to the emphasis conversion circuit 28 and is also written into the second frame memory 22** so as to be referred to when determining the hold count for the next frame.

The maximum value of the hold count is determined taking into account the response characteristics of the liquid crystal panel 14, etc. For example, when the maximum value of the hold count is 7, the hold count can be represented by 3 bits. When the video signal Va has the above-described format (1920×1080 pixels and 8 bits for each of RGB), as the second frame memory 22, a memory having a capacity of 18,662,400 bits (=1920×1080×3×3 bits) or more is used. In a general liquid crystal panel, when the maximum value of the hold count is determined to be 7 or more, double optical responsivity can be substantially completely prevented.

To the emphasis conversion circuit 28 are inputted the current frame gradation value Din(n) outputted from the two-clock delay circuit 25, the gradation value before change Din(hold) outputted from the first frame memory 21, and the hold count Cnt outputted from the hold count calculation circuit 27. The emphasis conversion circuit 28 determines an output gradation value Dout(n) based on these three values. When Cnt=0, the emphasis conversion circuit 28 outputs the current frame gradation value Din(n) as it is, as an output gradation value Dout(n). When Cnt≠0, the emphasis conversion circuit 28 determines an output gradation value Dout(n) using the LUT 31 and the arithmetic circuit 32.

FIG. 3 is a diagram showing an exemplary configuration of the LUT 31. As shown in FIG. 3, the LUT 31 stores in advance output gradation values Dout(n) in association with some of combinations of three values inputted to the emphasis conversion circuit 28. In an example shown in FIG. 3, as the representative values of the current frame gradation value Din(n), nine values (0, 32, 64, 96, 128, 160, 192, 224, and 255) are selected, and as the representative values of the gradation value before change Din(hold), the same nine values are selected. The hold count Cnt takes a value between 1 and 7, inclusive. In this case, the LUT 31 stores in advance 567 (=9×9×7) output gradation values Dout(n). The LUT 31 is formed using, for example, a ROM, etc.

When two gradation values Din(n) and Din(hold) are both included in the representative values, the emphasis conversion circuit 28 refers to the LUT 31 using these two gradation values and the hold count Cnt, and outputs a value read from the LUT 31 as it is, as an output gradation value Dout(n). When at least one of two gradation values Din(n)

and Din(hold) is not included in the representative values, the emphasis conversion circuit 28 refers to the LUT 31 two or four times using representative values close to the two gradation values and the hold count Cnt, performs, by the arithmetic circuit 32, a linear interpolation operation on two or four LUT outputs, and outputs a result thereof as an output gradation value Dout(n).

For example, when Din(n)=96, Din(hold)=50, and Cnt=1, the emphasis conversion circuit 28 refers to the LUT 31 by changing three values {Din(n), Din(hold), Cnt} in two ways, i.e., {96, 32, 1} and {96, 64, 1}, and performs a linear interpolation operation on obtained two LUT outputs. When Din(n)=100, Din(hold)=50, and Cnt=1, the emphasis conversion circuit 28 refers to the LUT 31** by changing the above-described three values in four ways, i.e., {96, 32, 1}, {96, 64, 1}, {128, 32, 1}, and {128, 64, 1}, and performs a linear interpolation operation on obtained four LUT outputs.

The contents of output gradation values Dout(n) stored in the LUT 31 and a linear interpolation operation performed by the arithmetic circuit 32 are determined such that in a video signal Vb the change in gradation value is emphasized more than that in a video signal Va, and the larger the hold count the smaller the degree of emphasis. Using such a LUT 31 and an arithmetic circuit 32, the emphasis conversion circuit 28 obtains a video signal Vb where the change in gradation value is emphasized more than that in the video signal Va, and makes the degree of emphasis smaller with a larger hold count.

Note that in the above description the emphasis conversion circuit 28 includes the LUT 31 and the arithmetic circuit 32 and obtains a video signal Vb using the LUT 31 and the arithmetic circuit 32. Instead of this, the emphasis conversion circuit 28 may include only the LUT 31 and obtain a video signal Vb using the LUT 31, or alternatively may include only the arithmetic circuit 32 and obtain a video signal Vb using the arithmetic circuit 32. According to the emphasis conversion circuit 28 including the LUT 31, by referring to the LUT 31, a video signal Vb can be obtained accurately and easily. According to the emphasis conversion circuit 28 including the arithmetic circuit 32, by obtaining a video signal Vb using the arithmetic circuit 32, the amount of circuitry for a LUT can be reduced. According to the emphasis conversion circuit 28 including the LUT 31 and the arithmetic circuit 32, the amount of circuitry can be reduced over the case of providing only the LUT 31, and a video signal Vb can be obtained accurately and easily over the case of providing only the arithmetic circuit 32.

A detail of the operation of the overdrive circuit 12 will be described below using four specific examples. FIGS. 4A to 4C are diagrams relating to a first example. FIG. 4A shows, for a given pixel, changes in signal values in the overdrive circuit 12 for every frame time, FIG. 4B shows changes in output gradation value Dout(n) for the pixel, and FIG. 4C shows changes in luminance (response waveform) for the pixel. FIGS. 5A to 5C, 6A to 6C, and 7A to 7C are diagrams showing the same contents as those in FIGS. 4A to 4C, for a second example, a third example, and a fourth example, respectively.

In the first example (see FIGS. 4A to 4C), the case in which the gradation value increases will be described. In the first example, the gradation value is first 0 and changes to 64 in the fourth frame. In this case, the liquid crystal display device 10 performs overdrive drive over seven frame periods from the fourth frame to the tenth frame.

In the fourth frame (a shaded portion in FIG. 4A), since Din(n)=64 and Din(n−1)=0, the amount of gradation change is +64. The gradation change detection circuit 26 determines that there is a change in gradation and thus outputs Cmp*=1. Since Cmp*=1, a gradation value before change Din(hold) stored in the first frame memory 21** is updated to 0 using a gradation value Din(n−1)* outputted from the one-clock delay circuit 24. The hold count calculation circuit 27 outputs Cnt=1, and the hold count stored in the second frame memory 22 is updated to 1. To the emphasis conversion circuit 28 are inputted Din(n)=64, Din(hold)=0, and Cnt=1. Since two gradation values are both included in the representative values in the LUT 31, the emphasis conversion circuit 28 outputs a value read from the LUT 31 as an output gradation value Dout(n) without using the arithmetic circuit 32. As a result, Dout(n)=160.

In the fifth frame, since Din(n)=64 and Din(n−1)=64, the amount of gradation change is 0. The gradation change detection circuit 26 determines that there is no change in gradation and thus outputs Cmp*=0. Since Cmp*=0, the gradation value before change Din(hold) stored in the first frame memory 21 is held without being updated. The hold count calculation circuit 27 adds 1 to the hold count (the value is 1) outputted from the second frame memory 22** and outputs Cnt*=2, and the hold count stored in the second frame memory 22 is updated to 2. To the emphasis conversion circuit 28 are inputted Din(n)=64, Din(hold)=0, and Cnt=2. Since two gradation values are both included in the representative values in the LUT 31, the emphasis conversion circuit 28 outputs a value read from the LUT 31 as an output gradation value Dout(n) without using the arithmetic circuit 32**. As a result, Dout(n)=76. For subsequent frames, likewise, in the sixth frame to the tenth frame, output gradation values Dout(n) are 68, 66, 65, 65, and 65, respectively.

Since in the eleventh frame Din(n)=64 and Din(n−1)=64, the amount of gradation change is 0. The gradation change detection circuit 26 determines that there is no change in gradation and thus outputs Cmp*=0. Since Cmp*=0, the gradation value before change Din(hold) stored in the first frame memory 21 is held without being updated. When 1 is added to the hold count (the value is 7) outputted from the second frame memory 22, a result thereof exceeds a maximum value of the hold count of 7. Hence, the hold count calculation circuit 27 outputs Cnt=0 and thus the hold count stored in the second frame memory 22 is reset to 0. To the emphasis conversion circuit 28 are inputted Din(n)=64, Din(hold)=0, and Cnt=0. Since Cnt=0, the emphasis conversion circuit 28 outputs the current frame gradation value Din(n) as an output gradation value Dout(n) without using the LUT 31 and the arithmetic circuit 32**. As a result, Dout(n)=64. For subsequent frames, likewise, in each frame in and after the twelfth frame, Dout(n)=64.

In the first example, the output gradation value changes as shown in FIG. 4B, and the luminance increases in the fourth frame and becomes substantially constant in and after the fifth frame, as shown in FIG. 4C. As such, in the first example, double optical responsivity caused by overdrive drive does not occur.

In the second example (see FIGS. 5A to 5C), the case will be described in which the gradation value increases and while overdrive drive is performed over a plurality of frame periods, the gradation value further increases. In the second example, the gradation value is first 0 and changes to 64 in the fourth frame and changes to 128 in the eighth frame. In this case, the liquid crystal display device 10 performs, in the fourth frame to the seventh frame, the same overdrive drive as that in the first example, and stops the overdrive drive and performs new overdrive drive over seven frame periods from the eighth frame to the fourteenth frame.

In the eighth frame (a shaded portion on the right side in FIG. 5A), since Din(n)=128 and Din(n−1)=64, the amount of gradation change is +64. The gradation change detection circuit 26 determines that there is a change in gradation and thus outputs Cmp*=1. Since Cmp*=1, a gradation value before change Din(hold) stored in the first frame memory 21** is updated to 64 using a gradation value Din(n−1)* outputted from the one-clock delay circuit 24. The hold count calculation circuit 27 outputs Cnt=1, and the hold count stored in the second frame memory 22 is updated to 1. To the emphasis conversion circuit are inputted Din(n)=128, Din (hold)=64, and Cnt=1. Since two gradation values are both included in the representative values in the LUT 31, the emphasis conversion circuit 28 outputs a value read from the LUT 31 as an output gradation value Dout(n) without using the arithmetic circuit 32. As a result, Dout(n)=166. For subsequent frames, likewise, in the ninth frame to the thirteenth frame, output gradation values Dout(n) are 137, 133, 131, 129, and 129, respectively. In each frame in and after the fourteenth frame, Dout(n)=128.

In the second example, the output gradation value changes as shown in FIG. 5B, and the luminance increases in the fourth frame, becomes substantially constant from the fifth frame to the seventh frame, further increases in the eighth frame, and becomes substantially constant in and after the ninth frame, as shown in FIG. 5C. As such, in the second example, too, double optical responsivity caused by overdrive drive does not occur.

In the third example (see FIGS. 6A to 6C), the case will be described in which the gradation value decreases and while overdrive drive is performed over a plurality of frame periods, the gradation value increases. In the third example, the gradation value is first 128 and changes to 64 in the fourth frame and changes to 128 in the eighth frame. In this case, the liquid crystal display device 10 performs overdrive drive in the fourth frame to the seventh frame, and stops the overdrive drive and performs new overdrive drive over seven frame periods from the eighth frame to the fourteenth frame.

In the third example, the output gradation value changes as shown in FIG. 6B, and the luminance decreases in the fourth frame, becomes substantially constant from the fifth frame to the seventh frame, increases in the eighth frame, and becomes substantially constant in and after the ninth frame, as shown in FIG. 6C. As such, in the third example, too, double optical responsivity caused by overdrive drive does not occur.

In the fourth example (see FIGS. 7A to 7C), the case will be described in which the gradation value increases and while overdrive drive is performed over a plurality of frame periods, the gradation value increases slightly due to the influence of noise. In the fourth example, the gradation value is first 0 and changes to 64 in the fourth frame and changes to 67 in the seventh frame for only one frame period due to the influence of noise.

In the seventh frame (a shaded portion on the right side in FIG. 7A), since Din(n)=67 and Din(n−1)=64, the amount of gradation change is +3. The gradation change detection circuit 26 determines that there is no change in gradation and thus outputs Cmp*=0. Since Cmp*=0, a gradation value before change Din(hold) stored in the first frame memory 21 is held without being updated. The hold count calculation circuit 27 adds 1 to the hold count (the value is 3) outputted from the second frame memory 22 and outputs Cnt=4, and the hold count stored in the second frame memory 22 is updated to 4. To the emphasis conversion circuit 28 are inputted Din(n)=67, Din(hold)=0, and Cnt=4. Though the value of Din(hold) is included in the representative values in the LUT 31, the value of Din(n) is not included in the representative values in the LUT 31. The emphasis conversion circuit 28 refers to the LUT 31 by changing three values {Din(n), Din(hold), Cnt} in two ways, i.e., {64, 0, 4} and {96, 0, 4}, and performs, by the arithmetic circuit 32, a linear interpolation operation on obtained two LUT outputs. As a result, Dout(n)=69. Output gradation values Dout(n) in and after the eighth frame are the same as those in the first example.

In the fourth example, the output gradation value changes as shown in FIG. 7B, and the luminance changes, as shown in FIG. 7C, in substantially the same manner as in the second example. Even in the fourth example in which the gradation value changes slightly due to the influence of noise in the above-described manner, double optical responsivity caused by overdrive drive does not occur.

Figure 10A:
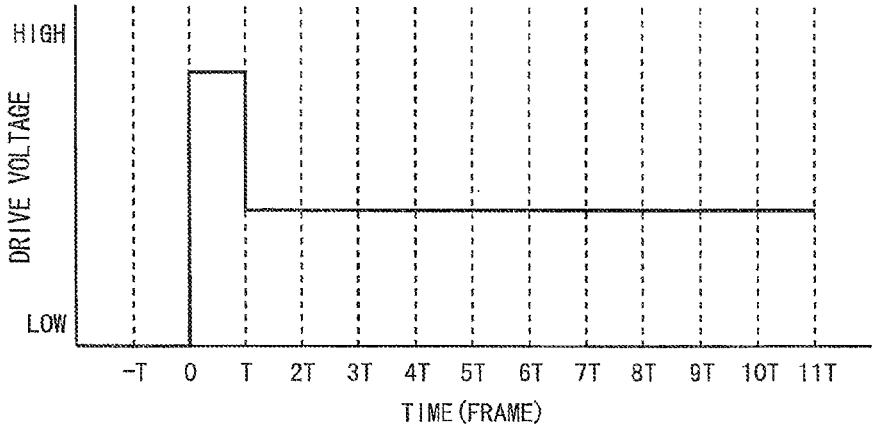
Fig. 10A (Conventional Art)
FIG. 10A is a diagram showing changes in drive voltage in a conventional liquid crystal display device that performs an overshoot process.
Figure 10B:
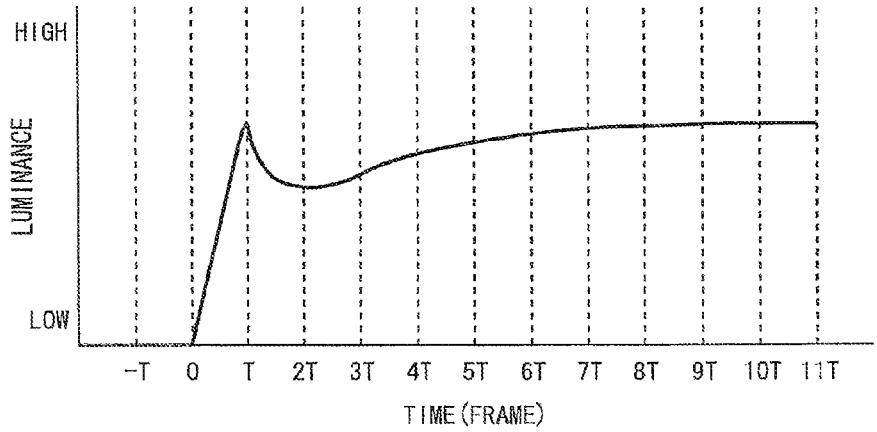
Fig. 10B (Conventional Art)
FIG. 10B is a diagram showing changes in luminance in the conventional liquid crystal display device that performs an overshoot process.
Figure 11:
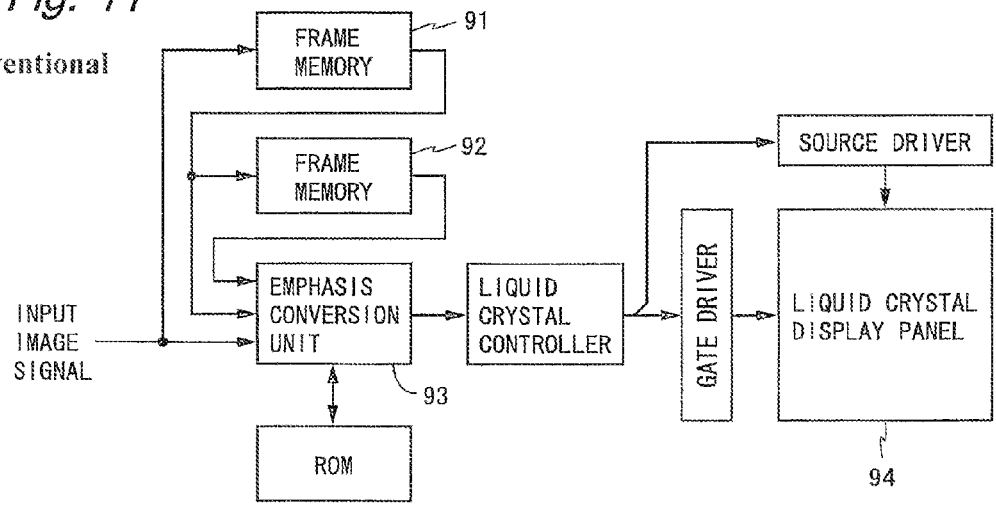
Fig. 11 (Conventional Art)
FIG. 11 is a block diagram showing a configuration of a conventional liquid crystal display device.
Figure 12A:
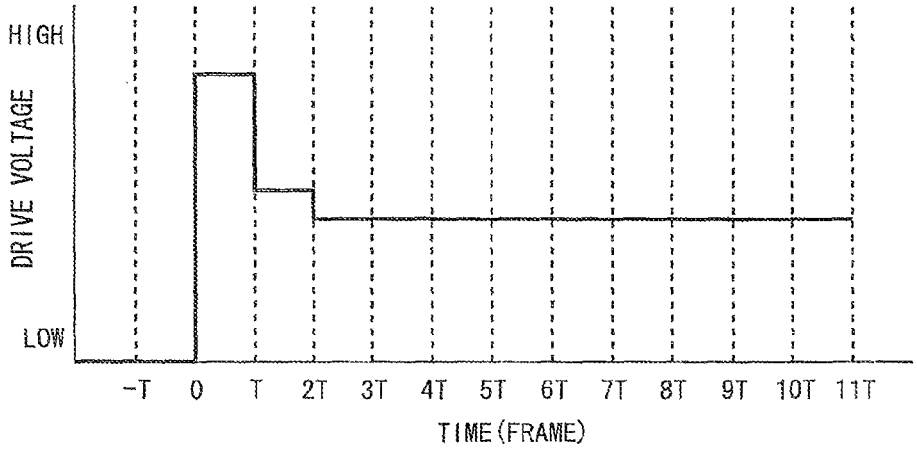
Fig. 12A (Conventional Art)
FIG. 12A is a diagram showing changes in drive voltage in the liquid crystal display device shown in FIG. 11.
Figure 12B:
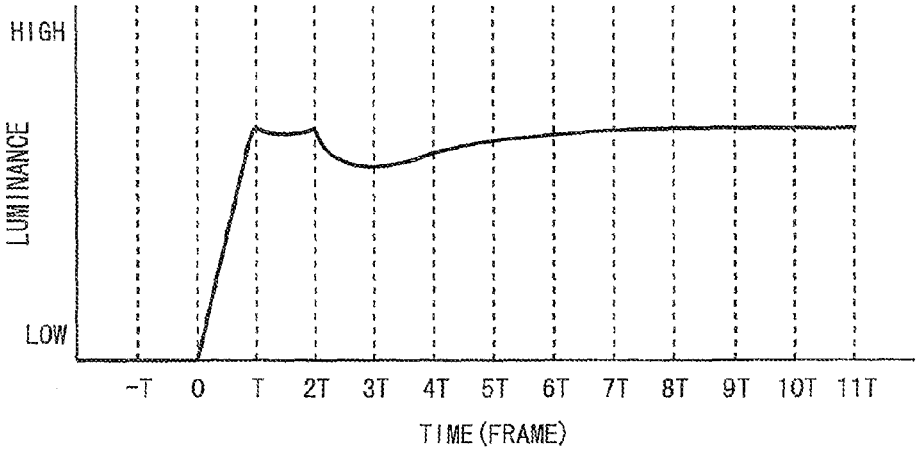
Fig. 12B (Conventional Art)
FIG. 12B is a diagram showing changes in luminance in the liquid crystal display device shown in FIG. 11.
Figure 13:
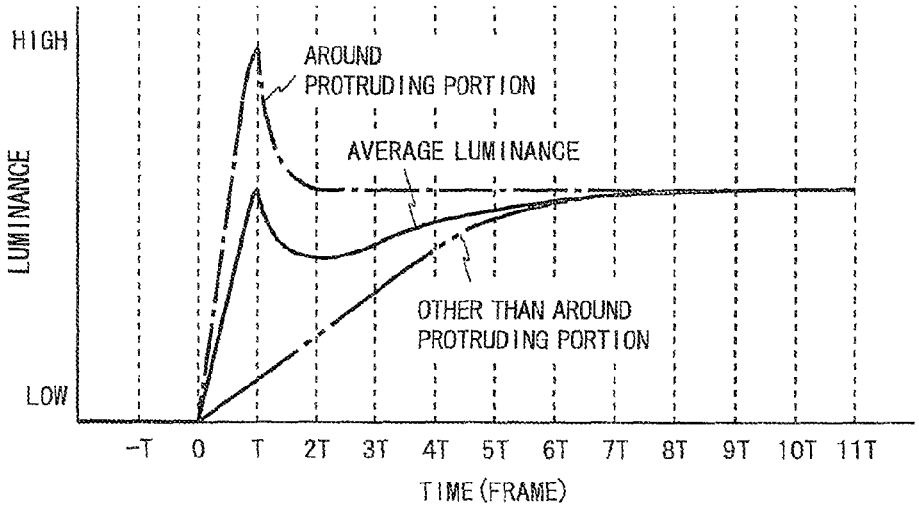
FIG. 13 is a diagram showing a detail of the changes in luminance shown in FIG. 10B.

Effects brought about by the liquid crystal display device 10 according to the present embodiment will be described below in comparison with conventional liquid crystal display devices. As described above, in a conventional liquid crystal display device performing overdrive drive, when the gradation value of a pixel increases, the drive voltage of the pixel changes as shown in FIG. 10A, and the luminance of the pixel changes as shown in FIG. 10B. In a liquid crystal display device shown in FIG. 11, when the gradation value of a pixel increases, the drive voltage of the pixel changes as shown in FIG. 12A, and the luminance of the pixel changes as shown in FIG. 12B. In these liquid crystal display devices, double optical responsivity where the luminance of a pixel increases once and decreases thereafter and increases again occurs.

Figure 8A:
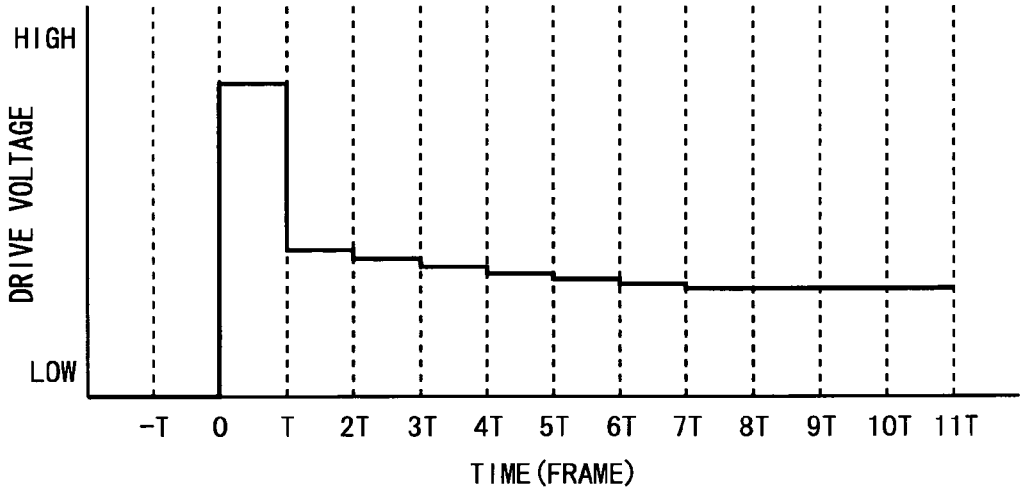
FIG. 8A is a diagram showing changes in drive voltage in the liquid crystal display device shown in FIG. 1.

FIG. 8A is a diagram showing changes in the drive voltage of a pixel for when the gradation value of the pixel increases in the liquid crystal display device 10 according to the present embodiment. As shown in FIG. 8A, in the first frame period occurring after the change of the gradation value (a frame period starting from time 0), a voltage higher than a voltage required to obtain a desired luminance is applied to a pixel circuit 15 in the liquid crystal panel 14. In the next frame period (a frame period starting from time T), a voltage lower than the voltage applied in the immediately previous frame period and higher than a voltage to be applied when a sufficient period of time has elapsed (hereinafter, referred to as a final voltage) is applied to the pixel circuit 15. In the next frame period (a frame period starting from time 2T), a voltage further lower than the voltage applied in the immediately previous frame period and higher than the final voltage is applied to the pixel circuit 15. Thereafter, in each frame period before the number of frames reaches a maximum value of the hold count of 7, a voltage lower than or equal to a voltage applied in an immediately previous frame period and higher than or equal to the final voltage is applied to the pixel circuit 15.

Figure 8B:
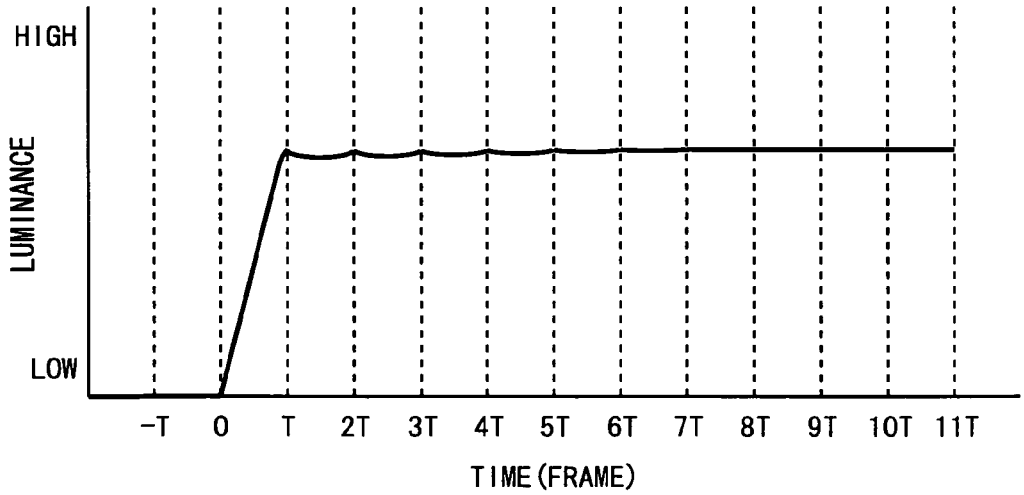
FIG. 8B is a diagram showing changes in luminance in the liquid crystal display device shown in FIG. 1.
Figure 9A:
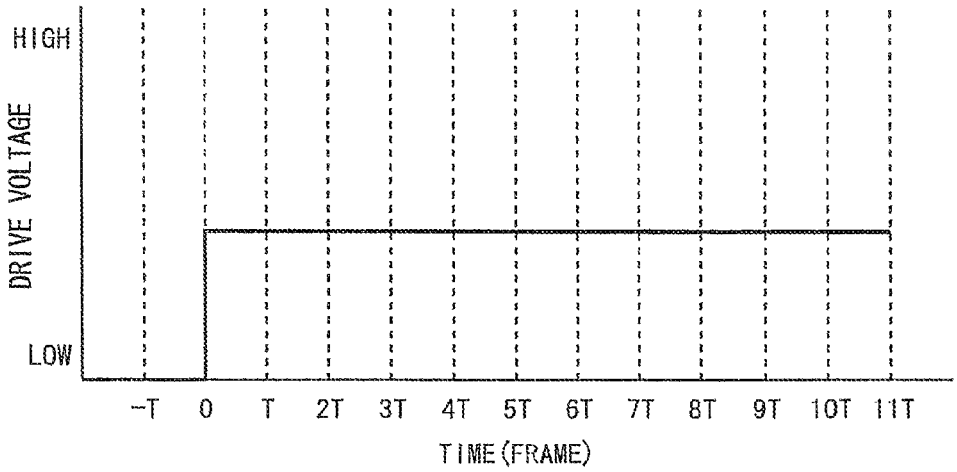
Fig. 9A (Conventional Art)
FIG. 9A is a diagram showing changes in drive voltage in a conventional liquid crystal display device that does not perform overdrive drive.
Figure 9B:
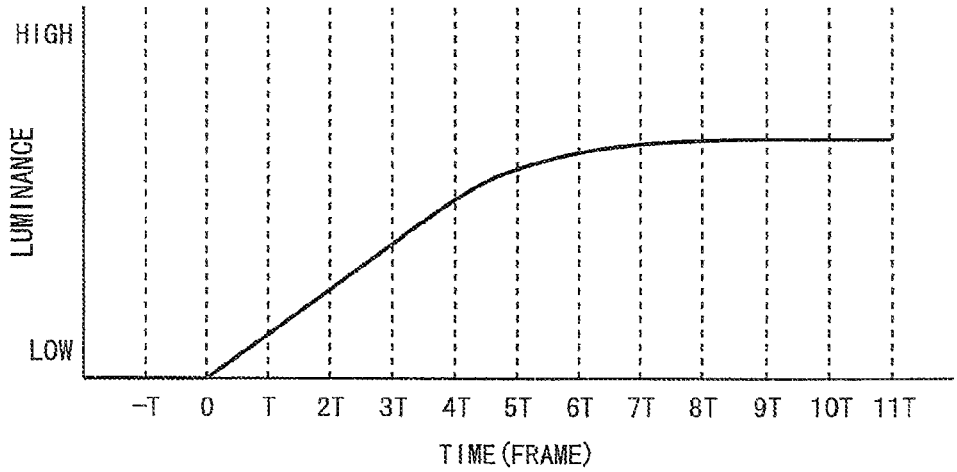
Fig. 9B (Conventional Art)
FIG. 9B is a diagram showing changes in luminance in the conventional liquid crystal display device that does not perform overdrive drive.

When the drive voltage of a pixel changes as shown in FIG. 8A, the luminance of the pixel changes as shown in FIG. 8B. Specifically, the luminance reaches a desired level in the first frame period occurring after the change of a gradation value, and is maintained at substantially that level in subsequent frame periods. Therefore, in the liquid crystal display device 10, double optical responsivity does not occur when the luminance of a pixel increases. For the same reason, in the liquid crystal display device 10, when the gradation value of a pixel decreases, too, double optical responsivity does not occur. As such, according to the liquid crystal display device 10 according to the present embodiment, double optical responsivity occurring due to overdrive drive can be prevented.

As described above, a liquid crystal display device 10 according to the present embodiment includes a liquid crystal panel 14; a first frame memory 21 (first storage unit) that stores, when a gradation value of a pixel included in an input video signal has been changed from the previous frame, a gradation value before change, for each pixel; a hold count calculation circuit 27 that determines, for each pixel, the hold count (the number of frames inputted after a change of a gradation value); a second frame memory 22 (second storage unit) that stores the hold counts determined by the hold count calculation circuit 27; an emphasis conversion circuit 28 that obtains a video signal (emphasis video signal) that compensates for the optical response characteristics of the liquid crystal panel 14 based on the input video signal, the gradation values before change which are stored in the first frame memory 21, and the hold counts determined by the hold count calculation circuit 27; and a liquid crystal drive circuit 13 that drives the liquid crystal panel 14 based on the emphasis video signal.

As such, in the liquid crystal display device 10 according to the present embodiment, an emphasis video signal that compensates for the optical response characteristics of the liquid crystal panel 14 is obtained based on an input video signal, gradation values before change, and the hold counts, and the liquid crystal panel 14 is driven based on the emphasis video signal. Accordingly, by obtaining an emphasis video signal according to the elapsed time after the change of gradation value by referring to the hold counts, the optical response characteristics of the liquid crystal panel 14 are favorably compensated for, enabling to prevent double optical responsivity occurring due to overdrive drive.

In addition, the liquid crystal display device 10 further includes a third frame memory 23 (third storage unit) that stores one frame of the input video signal and outputs a video signal of the previous frame; and a gradation change detection circuit 26 that compares the input video signal with the video signal of the previous frame outputted from the third frame memory 23 to determine, for each pixel, whether a gradation value has been changed from the previous frame. Accordingly, a determination as to whether a gradation value has been changed from the previous frame can be easily made using the third frame memory 23 and the gradation change detection circuit 26.

When the gradation value of a pixel is changed by a value greater than or equal to a predetermined value between the input video signal and the video signal of the previous frame outputted from the third frame memory 23, the gradation change detection circuit 26 determines that the gradation value has been changed from the previous frame. Accordingly, a situation can be prevented where, when a gradation value slightly fluctuates due to the influence of noise, display is performed with the noise being emphasized by overdrive drive.

A maximum value of the hold counts determined by the hold count calculation circuit 27 is 3 or more (here, 7). Accordingly, by referring to the hold counts whose maximum value is 3 or more, elapsed time after the change of gradation value is measured for at least three frame periods, and an emphasis video signal according to the elapsed time is obtained. By this, the optical response characteristics of the liquid crystal panel 14 are favorably compensated for, enabling to prevent double optical responsivity occurring due to overdrive drive.

The emphasis conversion circuit 28 obtains an emphasis video signal where the changes in gradation values are emphasized more than those in the input video signal, and makes the degree of emphasis smaller with larger hold counts determined by the hold count calculation circuit 27. As such, when an emphasis video signal is obtained by performing a process of emphasizing changes in gradation values on an input video signal, the degree of emphasis is made smaller with longer elapsed time after the change of gradation value by referring to the hold counts. By this, an emphasis video signal capable of favorably compensating for the optical response characteristics of the liquid crystal panel 14 can be obtained. By driving the liquid crystal panel 14 based on the emphasis video signal, double optical responsivity occurring due to overdrive drive can be prevented.

Double optical responsivity occurs when a liquid crystal panel has a response speed slower than one frame period. Furthermore, according to the liquid crystal display device 10 according to the present embodiment, even when a liquid crystal panel with a response speed slower than two frame periods is used, double optical responsivity occurring over two frame periods or more due to overdrive drive can be prevented. In particular, in an MVA-type liquid crystal panel where an alignment film surface is not subjected to a rubbing process as a domain control means and liquid crystal molecules are pretilted at a small angle by protrusions, etc., provided on a part of an electrode, double optical responsivity is likely to occur. According to the liquid crystal display device 10 according to the present embodiment, even when an MVA-type liquid crystal panel is used, double optical responsivity occurring over two frame periods or more due to overdrive drive can be prevented.

INDUSTRIAL APPLICABILITY

An image display device of the present invention has a feature that the device can prevent double optical responsivity occurring due to overdrive drive, and thus, can be used as various image display devices such as liquid crystal display devices.

DESCRIPTION OF REFERENCE NUMERALS

10: Liquid Crystal Display Device
11: Timing Control Circuit
12: Overdrive Circuit
13: Liquid Crystal Drive Circuit
14: Liquid Crystal Panel
15: Pixel Circuit
21: First Frame Memory
22: Second Frame Memory
23: Third Frame Memory
24: One-Clock Delay Circuit
25: Two-Clock Delay Circuit
26: Gradation Change Detection Circuit
27: Hold Count Calculation Circuit
28: Emphasis Conversion Circuit
31: LUT
32: Arithmetic Circuit

The invention claimed is:

1. An image display device that performs signal processing on a video signal and thereby displays an image, the image display device comprising:

a display panel;

a first storage unit that stores, when a gradation value of a pixel included in an input video signal has been changed from a previous frame, a gradation value before change, for each pixel;

a hold count calculation unit that determines, for each pixel, a hold count indicating a number of frames inputted after a change of a gradation value;

a second storage unit that stores the hold counts determined by the hold count calculation unit;

an emphasis conversion unit that obtains an emphasis video signal based on the input video signal, the gradation values before change which are stored in the first storage unit, and the hold counts determined by the hold count calculation unit, the emphasis video signal compensating for optical response characteristics of the display panel; and a drive unit that drives the display panel based on the emphasis video signal.

2. The image display device according to claim 1, further comprising:

a third storage unit that stores one frame of the input video signal and outputs a video signal of the previous frame; and a gradation change detection unit that compares the input video signal with the video signal of the previous frame outputted from the third storage unit to determine, for each pixel, whether a gradation value has been changed from the previous frame.

3. The image display device according to claim 2, wherein when a gradation value of a pixel is changed by a value greater than or equal to a predetermined value between the input video signal and the video signal of the previous frame outputted from the third storage unit, the gradation change detection unit determines that the gradation value has been changed from the previous frame.

4. The image display device according to claim 1, wherein a maximum value of the hold counts determined by the hold count calculation unit is 3 or more.

5. The image display device according to claim 1, wherein the emphasis conversion unit obtains an emphasis video signal where the changes in gradation values are emphasized more than those in the input video signal, and makes a degree of emphasis smaller with larger hold counts determined by the hold count calculation unit.

6. The image display device according to claim 5, wherein the emphasis conversion unit includes a look up table and obtains the emphasis video signal using the look up table.

7. The image display device according to claim 5, wherein the emphasis conversion unit includes an arithmetic circuit and obtains the emphasis video signal using the arithmetic circuit.

8. The image display device according to claim 5, wherein the emphasis conversion unit includes a look up table and an arithmetic circuit and obtains the emphasis video signal using the look up table and the arithmetic circuit.

9. The image display device according to claim 1, wherein the display panel has a response speed slower than two frame periods.

10. The image display device according to claim 9, wherein the display panel is an MVA-type liquid crystal panel.

11. An image display method for performing signal processing on a video signal and thereby displaying an image on a display panel, the method comprising the steps of:

storing, when a gradation value of a pixel included in an input video signal has been changed from a previous frame, a gradation value before change, for each pixel;

determining, for each pixel, a hold count indicating a number of frames inputted after a change of a gradation value;

storing the determined hold counts;

obtaining an emphasis video signal based on the input video signal, the stored gradation values before change, and the determined hold counts, the emphasis video signal compensating for optical response characteristics of the display panel; and driving the display panel based on the emphasis video signal.

* * * * *